US009196942B2

(12) United States Patent
Päri et al.

(10) Patent No.: US 9,196,942 B2
(45) Date of Patent: Nov. 24, 2015

(54) ADAPTABLE RESONATOR FILTER

(75) Inventors: Petri Päri, Kempele (FI); Jukka Puoskari, Tupos (FI)

(73) Assignee: Intel Corporation, Santa Clara, CA (US)

( * ) Notice: Subject to any disclaimer, the term of this patent is extended or adjusted under 35 U.S.C. 154(b) by 530 days.

(21) Appl. No.: 13/293,831

(22) Filed: Nov. 10, 2011

(65) Prior Publication Data

US 2012/0119851 A1 May 17, 2012

(30) Foreign Application Priority Data

Nov. 12, 2010 (FI) ..... 20106189

(51) Int. Cl.

| | |
|---|---|
| ***H01P 1/20*** | (2006.01) |
| ***H01P 3/06*** | (2006.01) |
| ***H01P 7/04*** | (2006.01) |
| ***H01P 1/205*** | (2006.01) |
| ***H01P 5/04*** | (2006.01) |

(52) U.S. Cl.

CPC ..... *H01P 1/2053* (2013.01); *H01P 5/04* (2013.01)

(58) Field of Classification Search

CPC .... H01P 1/205; H01P 1/20336; H01P 1/2056
USPC ..... 333/203, 206, 207, 224
See application file for complete search history.

(56) References Cited

U.S. PATENT DOCUMENTS

| | | | | |
|---|---|---|---|---|
| 3,659,232 | A * | 4/1972 | Foley | 333/206 |
| 3,693,115 | A | 9/1972 | Edson | |
| 3,792,385 | A | 2/1974 | Napoli et al. | |
| 5,023,579 | A * | 6/1991 | Bentivenga et al. | 333/203 |
| 5,410,284 | A | 4/1995 | Jachowski | |
| 5,418,509 | A * | 5/1995 | Piirainen | 333/203 |
| 5,705,965 | A * | 1/1998 | Podvin et al. | 333/203 |
| 6,025,764 | A | 2/2000 | Pelz et al. | |

FOREIGN PATENT DOCUMENTS

| | | | |
|---|---|---|---|
| CN | 101834334 | A | 9/2010 |
| DE | 102006061141 | A1 | 6/2008 |
| FI | 982551 | A | 12/1999 |
| JP | 2004007056 | A | 1/2004 |
| WO | 2004084340 | A1 | 9/2004 |

OTHER PUBLICATIONS

Finland Search Report for Application No. 20106189 dated Oct. 12, 2011, 2 pages.
European Search Report for Application No. 11187668.6 dated Feb. 6, 2012, 6 pages.

* cited by examiner

*Primary Examiner* — Robert Pascal
*Assistant Examiner* — Kimberly Glenn
(74) *Attorney, Agent, or Firm* — Schwegman Lundberg & Woessner, P.A.

(57) ABSTRACT

An adaptable filter made up of cavity resonators. The adaptation takes place by adjusting the connection from the input connector (CN1) of the filter to the input resonator and from the output resonator to the output connector. For adjusting the connection there is a coaxial transfer line (TL1), the outer conductor (OC1) of which is connected by its one end to the wall of the filter casing and by its other end to the outer conductor of the connector (CN1) and the inner conductor of which extends from the middle conductor of the connector to the cavity of the resonator and there into the internal connecting member of the resonator. A middle rod belonging to the inner conductor is surrounded over a certain distance by a cylindrical conductive tuning element, which can be moved by sliding it along the middle rod.

6 Claims, 3 Drawing Sheets

ADAPTABLE RESONATOR FILTER

BACKGROUND OF THE INVENTION

The invention relates to a filter composed of cavity resonators, the adaptation of which filter can be adjusted during use. A typical application of the invention is an antenna filter of a base station of some mobile network.

Cavity resonators are generally used in communications networks for making filters, especially when the effect of the signal to be transferred is relatively large. This is due to the fact that losses caused by such resonator filters are small, which means only a slight damping of the effective signal. Additionally their response characteristics are easy to control and adjust even according to strict specifications.

In most filters, both the center frequency and bandwidth of the pass band of the filter is meant to be fixed. In some filters the bandwidth of the pass band of the filter is meant to be fixed, but the center frequency of the pass band can be made adjustable within range of center frequencies. Thus an adjustment possibility for altering the center frequency of the pass band is needed in the filter in addition to the basic cavity filter construction.

FIG. 1 shows an example of such a resonator filter known from publication EP 1604425. The filter 100 has a conductive casing formed by a bottom 101, walls 102 and a lid 105, the space of which casing is divided with conductive partitions 112 into resonator cavities. The figure shows as a cross-section an input resonator 110 and part of a following resonator 120. Each resonator cavity has a inner conductor 111; 121 of the resonator, which inner conductor is connected in a conductive manner by its lower end to the bottom 101 and the upper end of which is in the air, so the resonators are coaxial-type quarter-wave resonators. For adjusting the filter each cavity has a tuning element TE1; TE2. This is a dielectric piece, which is situated directly beneath the lid 105 of the resonator on slide rails, so that it can be moved in the horizontal plane. The moving takes place by means of a control rod RD above the lid, to which rod the tuning element is attached by means of a peg TP passing through an elongated opening SL in the lid. The tuning elements of different resonators are attached to the same control rod. When the control rod is moved, the specific frequencies of all the resonators are altered by the same amount, whereby the pass band of the filter is moved. When each of the tuning elements is completely above the inner conductor the electric lengths of the resonators are at their longest and the pass band of the filter is at its lowest.

Changing the position of the adjustment mechanism of the filter naturally some what affects the adaptation of the filter, i.e. it affects what kind of impedance it is "seen" as from the input wire and correspondingly from the output wire. The change in the adaptation is also manifested from a change in reflection coefficient of the filter: a rise in the reflection coefficient on the pass band of the filter shows a worsening of the adaptation more clearly than a change in the impedance. When the bandwidth of the pass band is relatively small, for example less than a percent of the frequency of the carrier wave of the signal, variation in the level of the reflection coefficient may be insignificantly small. Whenever the pass band is moved over wider range of frequencies, the larger the variation in the level of the reflection coefficient also is. The need for moving the pass band is especially large in a system according to the LTE standard (Long Term Evolution) designed for the 2.6 GHz area. In the filter according to FIG. 1 and in other corresponding known filters the input of the filter is arranged so that the connection to the input resonator and the input impedance are in order in the middle of the adjustment area of the band. This leads to a situation where adaption errors occur in the ends of the adjustment area.

An arrangement for adjusting the input connection of the resonator filter and thus the adaptation of the input side is known from publication U.S. Pat. No. 6,025,764. There is a flexible metal strip in the cavity of the input resonator, which metal strip is attached at its one end to the middle conductor of an input connector. Its free end can be pushed by turning a screw in the side wall of the filter casing and the input connection can thus be changed. The adjustment is thus manual.

SUMMARY OF THE INVENTION

The object of the invention is to reduce the above-mentioned disadvantages related to prior art. The resonator filter according to advantageous embodiments of the invention is presented in the following description.

One aspect of the invention is the following: The resonator filter is adapted by adjusting the connection from its input connector to the input resonator and from the output resonator to the output connector. For adjusting the connection there is a coaxial transfer line, the outer conductor of which is connected by its one end to the wall of the filter casing and by its other end to the outer conductor of the connector and the inner conductor of which extends from the middle conductor of the connector to the cavity of the resonator and there into the internal connecting member of the resonator. A middle rod belonging to the inner conductor is surrounded over a certain range by a cylindrical conductive tuning element, which can be moved by sliding it along the middle rod. The tuning element forms a node with small impedance in the area with relatively large impedance in the transfer path. This node moves with the tuning element, whereby the strength and simultaneously adaptation of the connection between the input wire and the input resonator is changed.

It is an advantage of the invention that the adaptation of the resonator filter can be corrected during its use. As was mentioned, such a correction need typically arises when the pass band of the filter is moved over wide range. Additionally the correction of the adaptation can be arranged to be automatic using electric actuators, so that it occurs with the same control command as the moving of the pass band.

BRIEF DESCRIPTION OF THE DRAWINGS

In the following, the invention will be described in detail. In the description, reference is made to the appended drawings, in which.

DETAILED DESCRIPTION

Figure 1:
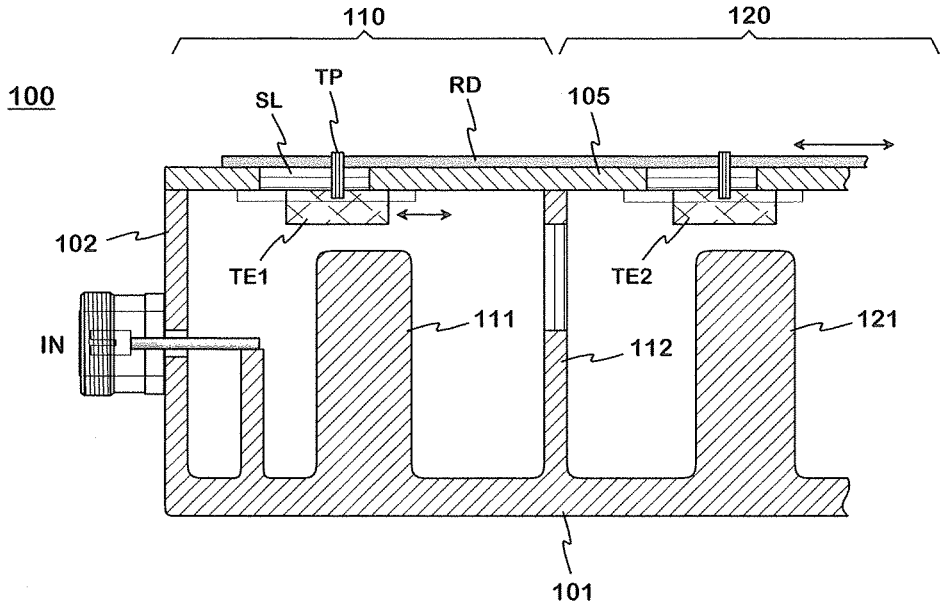
Fig. 1 PRIOR ART
FIG. 1 shows an example of a resonator filter according to prior art.
Figure 2:
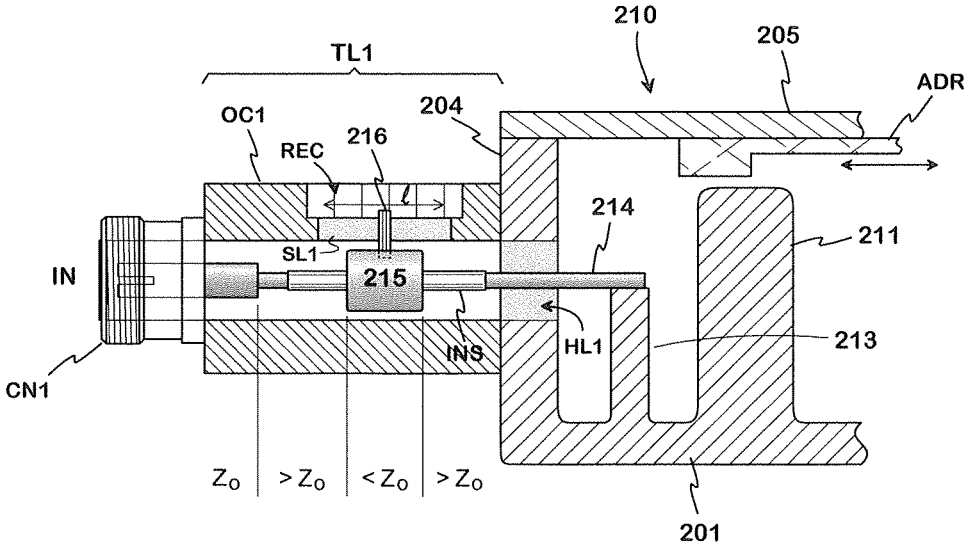
FIG. 2 shows an example of an adaptation arrangement on the input side in a filter according to the invention.

FIG. 1 was already described in connection with the description of prior art. FIG. 2 shows an example of the adaptation arrangement on the input side in a resonator filter according to the invention. The drawing is a vertical cross-section, and it shows a coaxial input connector CN1, a coaxial transfer line TL1 and an input resonator 210. The adjustment piece ADR under the lid 205, which piece moves the pass band of the filter, is also marked in the figure. There can be a separate actuator for moving the adjustment piece, which actuator together with the adjustment piece makes up the adjustment apparatus of the pass band. The transfer line is part of the transfer path of the filter, in such a way that its outer conductor OC1 is connected in a galvanic manner by its one end to the outer conductor of the input connector CN1 and by its other end to the end wall 204 of the filter casing, and the middle conductor is connected by its starting end to the middle conductor of the input connector and extends from there to the cavity of the input resonator through an opening HL1 in the wall 204. There the middle conductor is connected to the internal connecting member 213 of the input resonator, which connecting member is here a vertical conductor, which is connected by its lower end to the bottom 201 of the filter, near the inner conductor 211 of the input resonator. The middle conductor of the transfer line comprises a middle rod 214 and a cylindrical moveable tuning element 215, through which the middle rod passes.

The conductor of the tuning element 215 is insulated from the middle rod 214 with a dielectric layer INS, which is so thin that the tuning element is at the use frequencies of the filter functionally in short circuit to the middle rod. The dielectric layer is in the figure a coating on the middle rod, but it may also be coating of the surface of the hole in the tuning element. The tuning element is thus supported on the middle rod in an insulated manner. The friction between the tuning element and the middle rod is so small that the tuning element can be slid along the middle rod with relatively small force. The moving of the first tuning element takes place by means of a dielectric control pin 216 attached thereto. The control pin extends through a slit SL1 in the direction of the middle rod in the outer conductor OC1 to outside the cavity into a recess REC in the outer conductor.

When moving from the input connector CN1 the impedance of the transfer line is in the beginning the nominal impedance ZO of the transfer path, which is for example 50 Ohm. In the part of the transfer line between the starting end of the middle rod 214 and the tuning element 215 its impedance is significantly higher than ZO, because the diameter of the middle rod is significantly smaller than the diameter of the middle conductor of the connector. By the tuning element 215 the impedance of the transfer line is significantly smaller than ZO, because the diameter of the tuning element is significantly larger than the diameter of the middle conductor of the connector. From the tuning element onwards toward the input resonator the impedance of the transfer line is again the same as before the tuning element. The transfer line thus has a part with relatively small impedance between two parts with relatively large impedance. When the tuning element 215 is moved toward the input resonator, the part of the transfer line with small impedance moves along with it, whereby the connection between the resonator and the input connector is strengthened, and vice versa. The strengthening of the connection changes the input impedance of the filter in the opposite direction than moving the pass band of the filter downwards, to lower frequency. Thus the adaptation of the resonator filter may be corrected by moving the tuning element 215 toward the input resonator while the pass band of the filter is moved downwards, to lower frequency and toward the input connector CN1 while the pass band of the filter is moved upwards, to higher frequency.

The transfer line TL1 is naturally dimensioned so that a required scope is obtained in the adaptation adjustment area. In other words the diameter of the tuning element 215, the diameter of the middle rod 214, the adjustment displacement range [L1] of the tuning element and the distance of this displacement range [L1] from the wall of the filter are selected appropriately.

Figure 3:
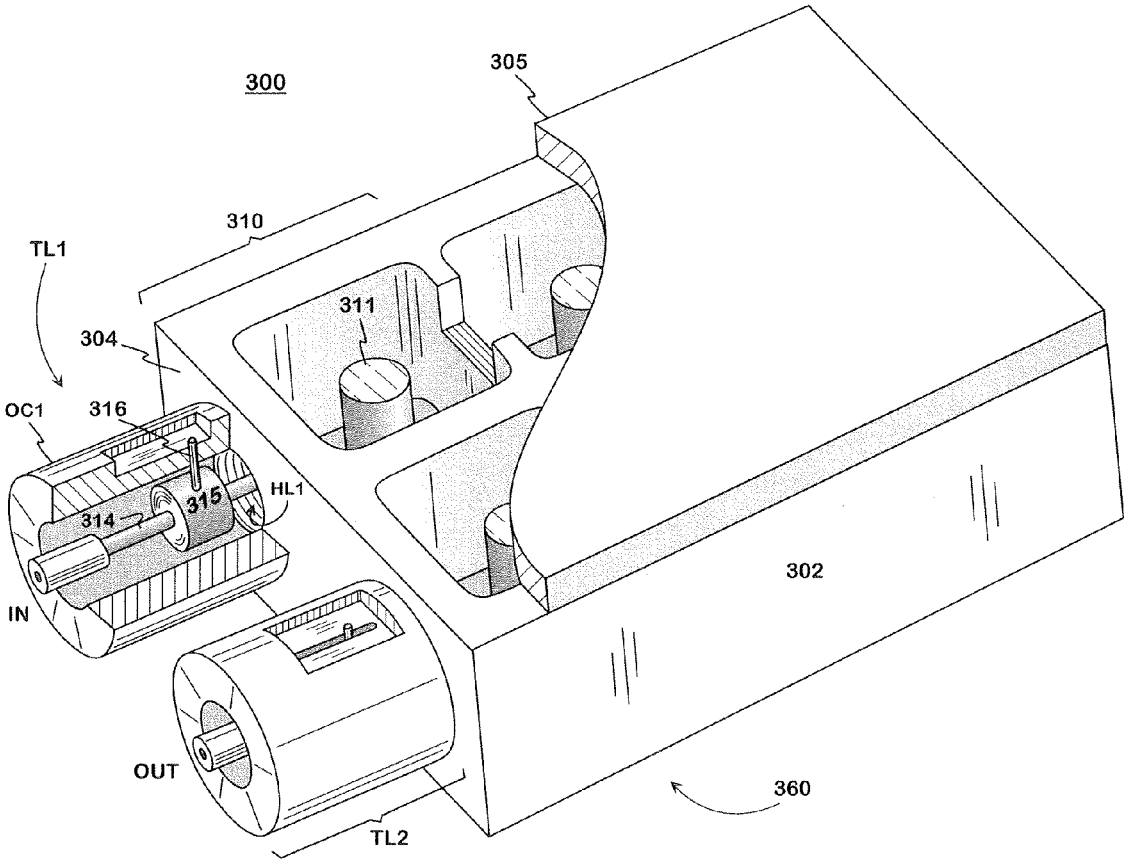
FIG. 3 shows an example of a adaptable filter according to the invention.

FIG. 3 shows an example of a resonator filter according to the invention. The filter 300 has a conductive casing, which is made up of a bottom, side walls 302, 10 end walls 304 and a lid 305. The space of the casing is with conductive partitions divided into resonator cavities. Each resonator cavity has an inner conductor 211 of the resonator, which inner conductor is connected in a conductive manner by its lower end to the bottom and the upper end of which is in the air, so the resonators are in this example coaxial-type quarter-wave resonators. The number of resonators is here six, however it shall be understood that any suitable number of resonators can be employed. When the filter is in use, its casing is part of the signal ground, i.e. ground, of the transfer path.

The filter 300 further comprises a first transfer line TL1 for adapting its input impedance and a second transfer line TL2 for adapting its output impedance. The first transfer line TL1 is connected to the input resonator 310. It has an outer conductor OC1, a middle rod 314, a tuning element 315 and a control pin 316 arranged in the same way as in FIG. 2. The outer conductor OC1 is cut open in the figure for the sake of clarity. The second transfer line TL2 is connected to the output resonator 360, and it is identical to the first transfer line. Only the middle conductors of the input and output connectors are seen in FIG. 3.

Figure 4:
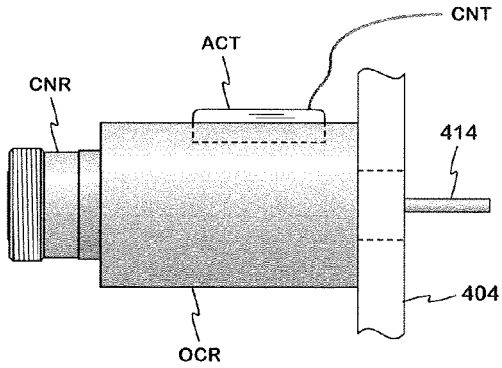
FIG. 4 shows a transfer line for adapting input/output impedance according to FIGS. 2 and 3 seen from the outside and FIG. 5 shows an example of the correcting of the adaptation in a filter according to the invention.

FIG. 4 shows a transfer line for adapting input/output impedance according to FIGS. 2 and 3 seen from the outside. The transfer line is between the coaxial connector CNR and the wall 404 of the filter casing. In a recess of the relatively thick outer conductor OCR there is an actuator ACT, with which the tuning element in the cavity of the transfer line is moved with the aid of the control pin extending out of the cavity. The actuator may for example be a device based on piezoelectricity, which forms a linear movement, or a device based on a stepper motor, or any other suitable mechanical means that can provide controlled linear displacement. The actuator ACT receives electric control CNT from a control unit, from which also the other actuators of the filter receive their control. Some actuators can be provided to realize the changing of the center frequency of the pass band of the filter, if the filter has such an adjustment possibility.

Figure 5:
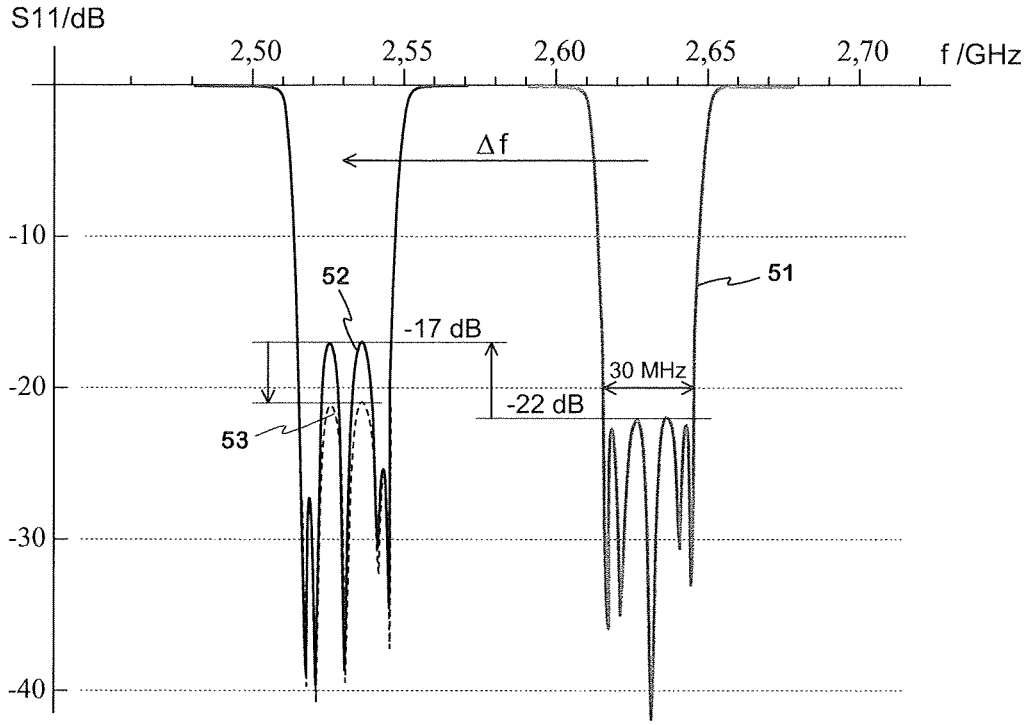

FIG. 5 shows an example of correcting the adaptation in a filter according to the invention. The success of the adaptation is manifested in indicators of the reflection coefficient S11: the smaller the value of the coefficient, the better the adaptation. The filter in question is a five-resonator filter, which has an adjustment arrangement also for moving the pass band. A pass band is required from the filter of the example, with which pass band the reflection coefficient is at the most −20 dB on a 30 MHz wide frequency area. Indicator 51 shows a change in the reflection coefficient as a function of frequency, when the medium frequency is about 2630 MHz and the adaptation is optimized. The reflection coefficient is about −22 dB or smaller in the 30 MHz area, i.e. it fulfils the requirements. Indicator 52 shows the change in the reflection coefficient, when the pass band is moved about 100 MHz downwards, lower frequency and nothing is done to the adaptation. It can be seen that the reflection coefficient rises in two spots within the 30 MHz area to a value of about −17 dB, which means that the requirements are not fulfilled. Indicator 53 shows the change in the reflection coefficient, when the pass band is still in the above-mentioned lower location and the adaptation of the filter is corrected with the arrangement according to the invention. It can be seen that the reflection coefficient is about −21 dB or smaller in the 30 MHz area, i.e. it again fulfils the requirements.

In the filter in the example the adjustment arrangement of the connection between the input connector and the input resonator is dimensioned so that the abovementioned correction of the adaptation requires moving the tuning element 215 a distance of 7 mm toward the input resonator. When such a move is realized with a shared control command simultaneously with the move of the pass band, the adaptation is corrected automatically at the same time as the pass band moves.

The definitions "horizontal", "vertical", "lower" and "upper" in this description and claims refer to the position of the filter, where the lid and the bottom of the filter casing are in a horizontal position, the lid being higher, and these definitions have nothing to do with the use position of the filter.

An adaptable resonator filter is described above. Its adjustment mechanism may naturally differ from what is shown in its details, such as the shape of its different structural parts. The internal connecting member of the resonator, to which the middle rod of the transfer line according to the invention is connected, may also be an expansion of the middle rod, which only has an electromagnetic connection to the resonator. The middle rod may also be connected in a conductive manner directly to the inner conductor of the resonator, which thus simultaneously functions as a connecting member. The invention does not take a stand regarding what kind of mechanism is used to move the pass band of the filter. The invention also does not limit the manufacturing manner and type of the filter; it may also be comprised of for example dielectric cavity resonators. The inventive idea may be applied in different ways as will be appreciated by those skilled in the art. An equivalent solution may also be conceived of, where the middle rod of the transfer line and the tuning element form a uniform inner conductor, which is moved in the longitudinal direction. Thus both ends of the inner conductor would have sliding surfaces, and the control pin could also be in the resonator cavity, extending through the lid.

What is claimed is:

1. An adaptable resonator filter, comprising a filter casing made up of a bottom, a plurality of walls including an end wall and a lid, which filter casing functions as a ground for a transfer path and is divided with conductive partitions into resonator cavities, an input connector with a middle conductor, an input resonator, an output resonator and an output connector with a middle conductor, wherein for adaptation of the filter;

the filter further comprises a first coaxial transfer line for adapting input impedance of the filter, which first transfer line comprises an outer conductor and a middle conductor including a middle rod and a moveable conductive tuning element through which the middle rod passes, wherein the first transfer line is connected between the input connector and the input resonator of the filter, the filter further comprises a second coaxial transfer line for adapting output impedance of the filter, which second transfer line comprises an outer conductor and a middle conductor including a middle rod and a moveable conductive tuning element through which the middle rod passes, wherein the second coaxial transfer line is connected between the output connector and the output resonator;

wherein the outer conductor of the first coaxial transfer line is connected by one end thereof to an outer conductor of the input connector and by another end thereof to the end wall of the filter casing, wherein a starting end of the middle rod of the first coaxial transfer line is connected to the middle conductor of the input connector and an opposing end of the middle rod connects to an internal connecting member of the input resonator;

wherein the outer conductor of the second coaxial transfer line is connected by one end thereof to an outer conductor of the output connector and by another end thereof to the end wall of the filter casing, wherein a starting end of the middle rod of the second coaxial transfer line is connected to the middle conductor of the output connector and an opposing end of the middle rod connects to an internal connecting member of the output resonator;

wherein each of the tuning elements of the first coaxial transfer line and the second coaxial transfer line is supported in an insulated manner on the middle rods of the first coaxial transfer line and the second coaxial transfer line and is configured so that the tuning element can be slid along the middle rod;

wherein the middle rods of each of the first coaxial transfer line and the second coaxial transfer line are smaller in diameter than a diameter of the middle conductors of the input connector and the output connector respectively, and wherein the tuning elements of each of the first coaxial line and the second coaxial line are larger in diameter than the diameter of the middle conductors of the input connector and the output connector, respectively; and wherein each of the first coaxial transfer line and the second coaxial transfer line includes a dielectric control pin that extends from the tuning elements thereof and is arranged for moving the respective tuning elements.

2. The resonator filter according to claim 1, wherein both said first and second transfer lines are dimensioned so that moving the respective tuning elements thereof along the middle rods thereof toward the respective input resonator and output resonator is arranged to cause a strengthening of a connection between the respective input or output resonator and the respective input or output connector of the filter.

3. The resonator filter according to claim 1, wherein an electrically controllable actuator is attached to said outer conductor of each of the first coaxial transfer line and the second coaxial transfer line for moving the respective tuning elements thereof, whereby said control pin is mechanically connected to said actuator.

4. The resonator filter according to claim 3, further comprising an adjustment apparatus having an actuator for moving the pass band of the filter and wherein the actuator associated with the adjustment apparatus and the actuators associated with said transfer lines have a shared control for correcting the adaptation of the filter at the same time as the pass band of the filter is moved.

5. The adjustable resonator filter according to claim 1, wherein said input and output resonators are coaxial quarter-wave resonators, whereby each resonator cavity has an inner conductor that is connected at a lower end thereof in a conductive manner to the bottom of the filter casing.

6. The adjustable resonator filter according to claim 1, wherein said input and output resonators are dielectric cavity resonators.

* * * * *